US006874263B2

(12) United States Patent
Ohmuku

(10) Patent No.: US 6,874,263 B2
(45) Date of Patent: Apr. 5, 2005

(54) BALLOON-TYPE ADVERTISING EQUIPMENT

(75) Inventor: Masao Ohmuku, Tokyo-to (JP)

(73) Assignee: Kabushiki Kaisha Appukoporeshon (JP)

( * ) Notice: Subject to any disclaimer, the term of this patent is extended or adjusted under 35 U.S.C. 154(b) by 0 days.

(21) Appl. No.: 10/341,240

(22) Filed: Jan. 13, 2003

(65) Prior Publication Data

US 2003/0131507 A1 Jul. 17, 2003

(30) Foreign Application Priority Data

Jan. 17, 2002 (JP) ..... 2002-008705

(51) Int. Cl.[7] ..... G09F 21/04; G09F 21/06
(52) U.S. Cl. ..... 40/590; 40/212; 40/606.18
(58) Field of Search ..... 40/212, 214, 590, 40/606.18, 610, 624, 736; 446/220, 225, 226; 296/21

(56) References Cited

U.S. PATENT DOCUMENTS 4,369,591 A * 1/1983 Vicino ..... 40/610
4,421,204 A * 12/1983 Lawrence ..... 182/50
4,776,121 A * 10/1988 Vicino ..... 40/610
5,269,623 A * 12/1993 Hanson ..... 404/6
5,402,591 A * 4/1995 Lee ..... 40/610
5,426,879 A * 6/1995 Hecker ..... 40/427
5,791,077 A * 8/1998 Felber ..... 40/610
6,008,938 A * 12/1999 Suehle et al. ..... 359/443
6,148,551 A * 11/2000 Glass ..... 40/214
6,240,666 B1 * 6/2001 Apel et al. ..... 40/610
6,668,475 B2 * 12/2003 Carolan ..... 40/610

FOREIGN PATENT DOCUMENTS

| | | |
|---|---|---|
| JP | 863114 | 3/1996 |
| JP | 234456 | 8/2000 |
| JP | 154623 | 6/2001 |
| JP | 287600 | 10/2001 |

OTHER PUBLICATIONS

Provisional Application No. 60/272,068, filed on Mar. 1, 2001.*

* cited by examiner

*Primary Examiner*—Brian K. Green
(74) *Attorney, Agent, or Firm*—Price, Heneveld, Cooper, DeWitt & Litton

(57) ABSTRACT

A balloon-type advertising equipment includes a vehicle and a balloon mounted on the vehicle which is adapted to be inflated and deflated as occasion demands to display an image and/or a message on the balloon. The equipment further includes blowers and lights mounted on an upper part of the vehicle wherein the balloon is bottom-opened box shaped and made of a sheet displaying thereon an image and/or message and having its lower part fixed to the upper part of the vehicle.

1 Claim, 7 Drawing Sheets

BALLOON-TYPE ADVERTISING EQUIPMENT

BACKGROUND OF THE INVENTION

1. Technical Field

The present invention relates to the balloon-type advertising equipment mounted on a vehicle, typically on a truck.

2. Description of the Related Art

Stationary advertising equipment, such as installed on the ground or rooftop of buildings, is conventionally well known. Mobile advertising equipment adapted to be mounted on the vehicle, such as a truck or a bus, is also well known as, for example, from Japanese Laid-Open Patent Application Gazette No. 2001-287600 of the present Applicant.

The other type of advertising equipment is also well known, for example, from Japanese Laid-Open Patent Application Gazette No. 1996-63114, which comprises a chassis provided with casters and a bag-like member adapted to be inflated by air pressure. The well known stationary advertising equipment requires complicated troublesome procedures before it is actually installed on a desired site such as premise or rooftop of building. First, an advertising agent must conclude a lease contract with an owner of the premise or the building to take over the site and then obtain official approval issued from a regulating authority. Only after receipt of such approval can the advertising agent carry out foundation work, ironwork and installation of the advertising equipment such as a signboard or the like. Thereafter, the advertising agent must file an application with a utility company for obtaining an electrical power inlet. These troublesome procedures necessarily lead to a relatively high cost. Removal of such stationary advertising equipment also requires a significant cost and is therefore unsuitable for short-term advertisements.

The mobile advertising equipment combined with the body of a vehicle, such as truck or bus, is effective as an urban oriented advertisement but unsuitable as advertising equipment used along the railway or the highway far away from urban locations. The advertising equipment comprising the chassis provided with the casters and the bag-like member adapted to be inflated by air pressure is disadvantageous in that a movable range thereof is strictly limited. In view of the problems found in the conventional advertising equipment as have been described above, it is a principal object of the present invention to provide a novel balloon-type advertising equipment adapted to be movable over a wide range and to offer effective advertisement at a low cost.

SUMMARY OF THE INVENTION

The object set forth above is achieved, according to the present invention, by a balloon-type advertising equipment comprising a vehicle and a balloon mounted on the vehicle wherein said balloon is adapted to be inflated and deflated as occasion demands and to display a commercial image and/or message. The vehicle may be moved with the balloon deflated to a desired site at which the balloon may be inflated again to offer effective advertisement.

According to one preferred embodiment of the present invention, the balloon is adapted to be illuminated from inside so that, even in the nighttime, the balloon can be inflated at a desired site and at a desired time to offer effective advertisement.

According to another preferred embodiment of the present invention, blowers and lighting means are mounted on an upper part of the vehicle body and the balloon is provided in the form of a bottom-opened box made of a sheet displaying thereon the commercial image and/or message and having its lower part fixed to the upper part of said vehicle body. In this way, four advertising panels are ensured and correspondingly effective advertising is offered.

According to still another preferred embodiment of the present invention, the balloon in the form of the bottom-open box is provided on its inner side with supporting means serving to prevent the balloon from collapsing. In this way, the advertising equipment can resist some degree of wind.

According to further another preferred embodiment of the present invention, a gate-shaped supporting pipe made of a synthetic resin sheet so as to be selectively inflated and deflated is mounted on the vehicle body and a blower for inflation of the supporting pipe is connected to the latter so that the sheet for display of commercial image and/or message may be laid over the inflated gate-shaped supporting pipe to form the balloon and to display the commercial image and/or message on front and rear halves of the inflated gate-shaped supporting pipe.

According to an additional preferred embodiment of the present invention, the supporting pipe is cylindrical. The cylindrical supporting pipe enables the balloon to be rapidly inflated even with a low power blower.

According to still additional preferred embodiment of the present invention, the gate-shaped supporting pipe comprises a pair of vertical pipe sections each made of a synthetic resin sheet, a single horizontal pipe section made of a synthetic resin sheet and a pair of L-shaped corner pipe sections serving to connect upper ends of said vertical pipe sections to longitudinally opposite ends of the horizontal pipe section.

According to further additional preferred embodiment of the present invention, the vertical pipe sections, the corner pipe sections and the horizontal pipe section are connected one to another by means of fasteners to facilitate assembly and disassembly of the supporting pipe.

According to another preferred embodiment of the present invention, the gate-shaped supporting pipe and the sheet laid over the gate-shaped supporting pipe so as to display the commercial image and/or message on the front and rear halves of the gate-shaped supporting pipe are connected to each other by means of fasteners. This facilitates the sheet displaying the commercial image and/or message not only to be rapidly assembled and disassembled but also to be exchanged with another sheet displaying another commercial image and/or message.

According to still another preferred embodiment of the present invention, the vehicle body is provided with the lighting means so as to be located between the front and rear halves of the sheet. The balloon illuminated from its inside makes the advertisement in the nighttime effective.

According to further another preferred embodiment of the present invention, the gate-shaped supporting pipe has its inner surface optimized for diffusive reflection. Diffusive reflection on the inner surface of the supporting pipe improves the illuminating effect for the commercial image and/or message.

These and other features, objects and advantages of the present invention will become apparent upon reading the following description thereof together with reference to the accompanying drawings.

DETAILED DESCRIPTION OF THE PREFERRED EMBODIMENTS

Figure 1:
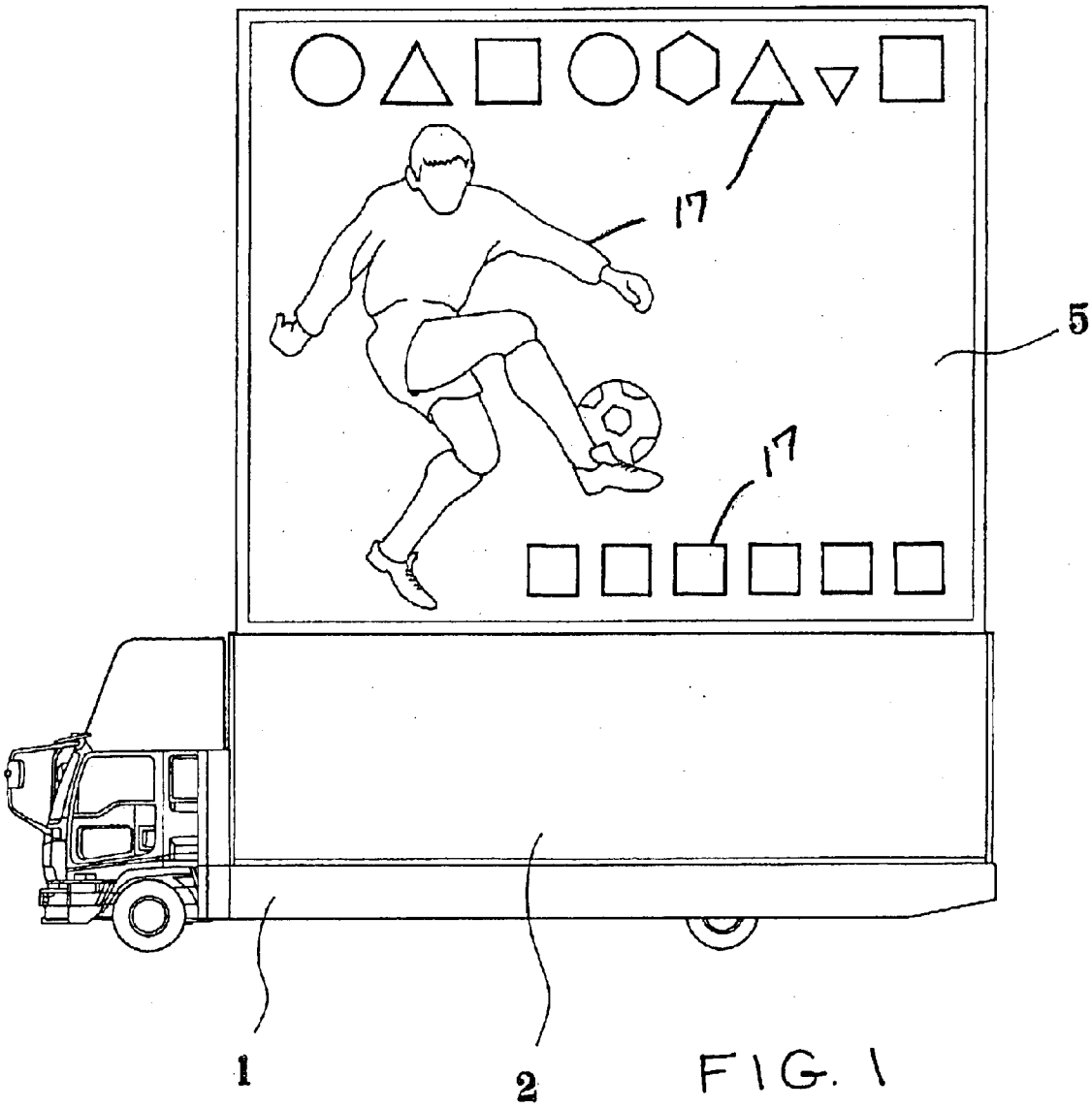
FIG. 1 is a side elevational view showing a basic embodiment of the balloon-type advertising equipment according to the present invention as viewed from a lateral face of the vehicle body.
Figure 2:
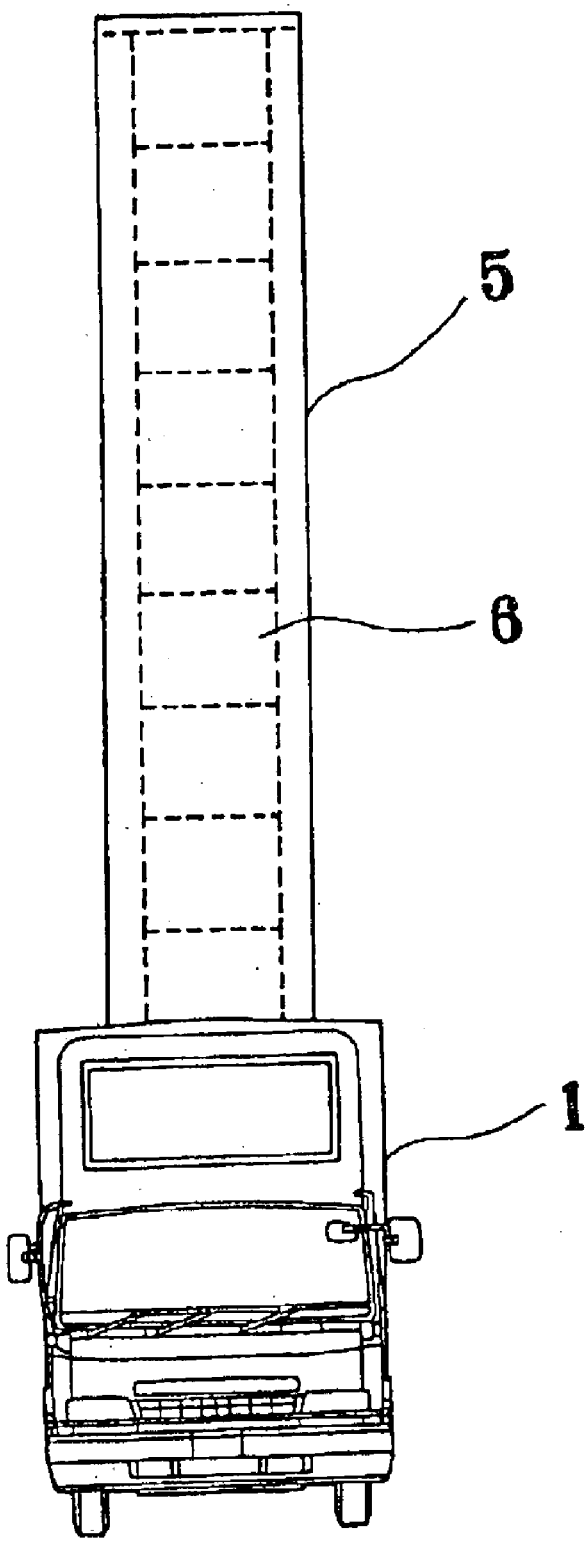
FIG. 2 is a front elevational view showing this embodiment as viewed from the front face of the vehicle body.
Figure 3:
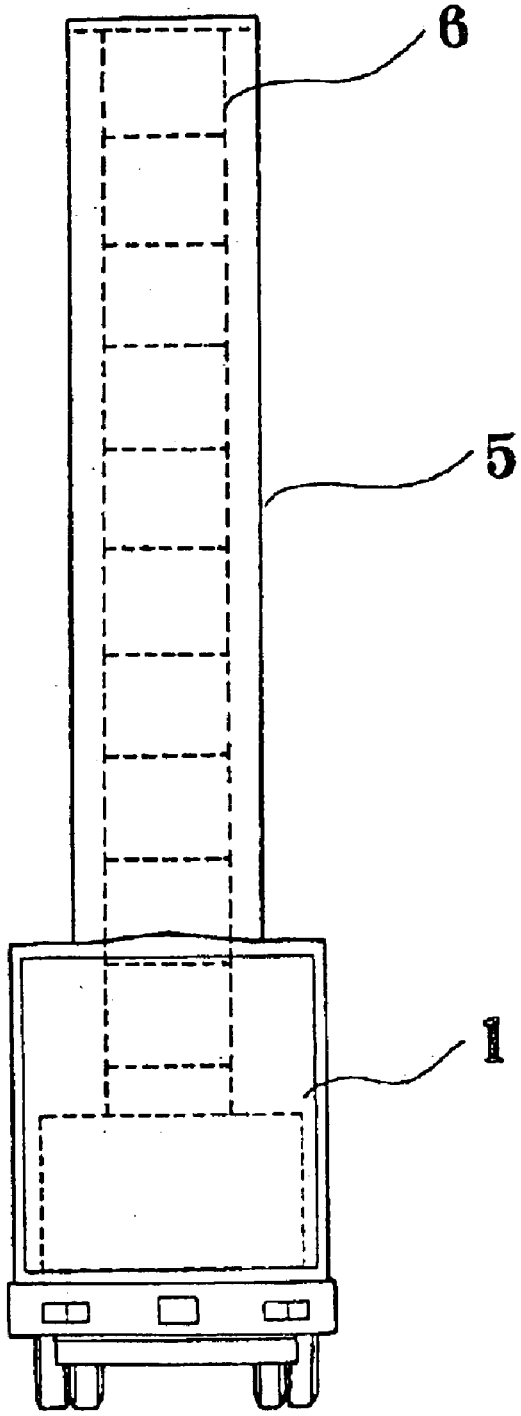
FIG. 3 is a rear elevational view showing this embodiment as viewed from the rear face of the vehicle body.
Figure 4:
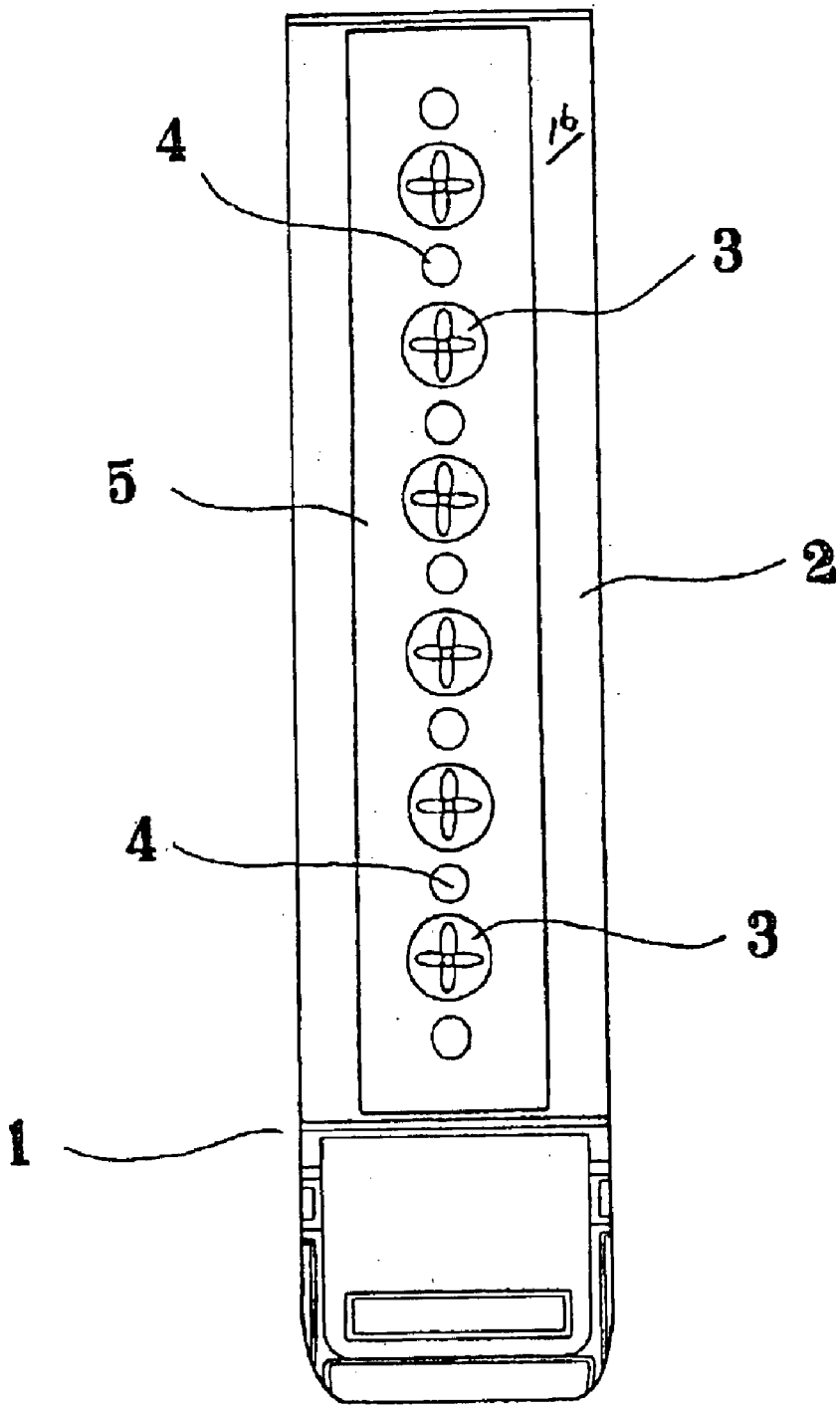
FIG. 4 is a top plan view of this embodiment.
Figure 5:
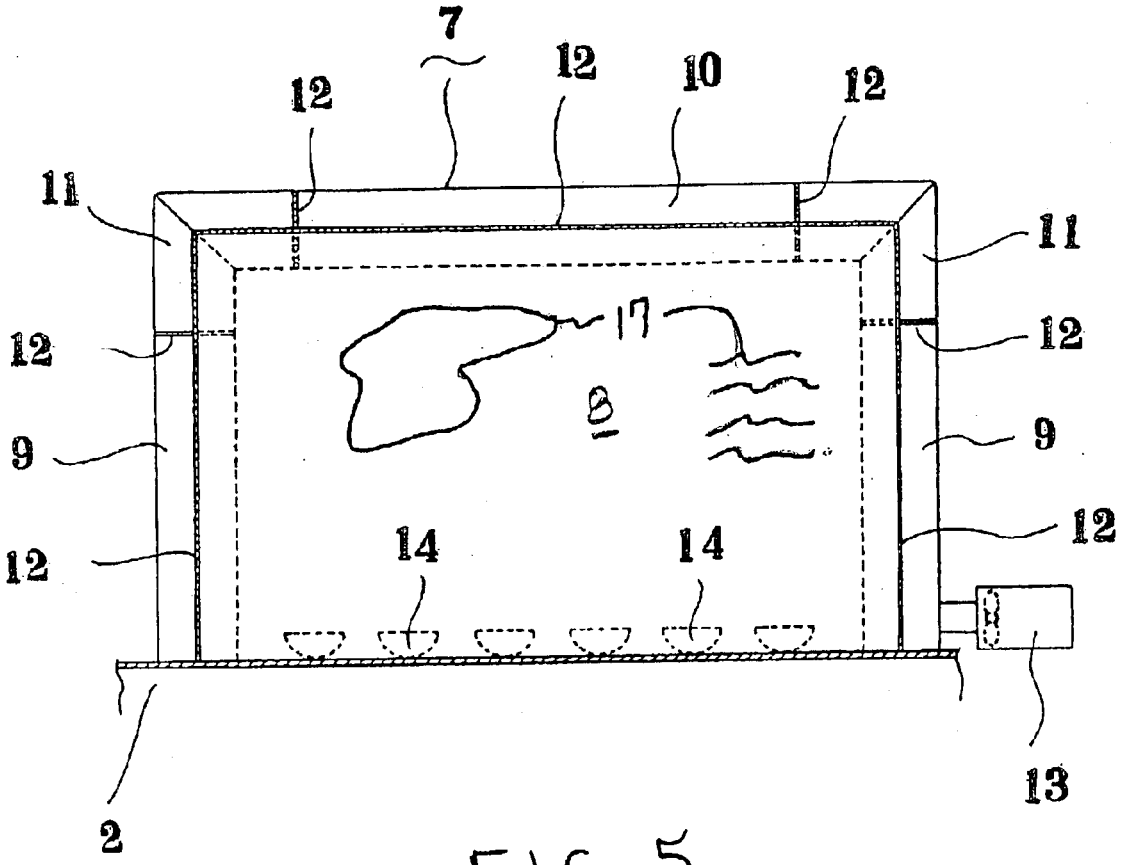
FIG. 5 is a side elevational view showing an alternative embodiment of the balloon-type advertising equipment according to the present invention with the vehicle body eliminated.

Details of the balloon-type advertising equipment according to the present invention will be more fully understood from the description given hereunder in reference with the accompanying drawings. FIGS. 1–4 show a basic embodiment of the balloon-type advertising equipment according to the invention and a reference numeral 1 designates a vehicle, which is a truck in the case of the illustrated embodiment. The vehicle is not limited to the truck and the other self-driven vehicles such as bus and tram also may be used to implement the present invention.

A body 2 of the vehicle 1 includes a plurality of blowers 3 and lighting means 4 mounted on the upper surface 16 (FIG. 4) of the bed of the truck body 2. Body 2 is further provided with a balloon 5 made of a translucent sheet so that the balloon 5 may be selectively inflated and deflated as occasion demands. According to the illustrated embodiment, the balloon 5 is provided in the form of a bottom-opened rectangular box made from the sheet by sewing or the other techniques so as to cover the blowers 3 and the lighting means 4 and a lower part of the balloon 5 formed in this manner is fixed to an upper part 16 of body 2.

The sheet forming the balloon 5 displays indicia 17 (FIG. 1) comprising a commercial image and/or message previously fixed to the sheet by printing or the other techniques. The balloon 5 is inflated by air blasting from the blowers 3 into the interior of balloon 5 and the commercial image and/or message is illuminated by the lighting means 4. Inside the balloon 5, there is provided a supporting member 6 (FIGS. 2 and 3) serving to protect the balloon 5 from being collapsed by wind. The supporting member 6 may be provided in the form of extensible columnar supports located at four corners of the balloon 5 or in the form of extensible ladders located at both sides within the balloon 5. The supporting member 6 is not limited to an extensible member and an erectable or inclinable supporting member also may be used.

While the balloon 5 can be supported only by the supporting member 6 without provision of the blower 3, the balloon 5 can be inflated with better appearance by the provision of the blowers 3 and, thereby, the advertising effect can be improved. Blowers 3 may be replaced by a heating burner for a hot-air type balloon or a suitable lightweight gas to inflate the balloon 5 and thereby to improve the advertising effect. The bottom edge of the balloon is suitably sealed to the vehicle body 2 over the blowers 3 and lights 4 to allow inflation of the balloon. An alternative embodiment adapted to be easily put into practical use is shown by FIGS. 5–8.

Figure 6:
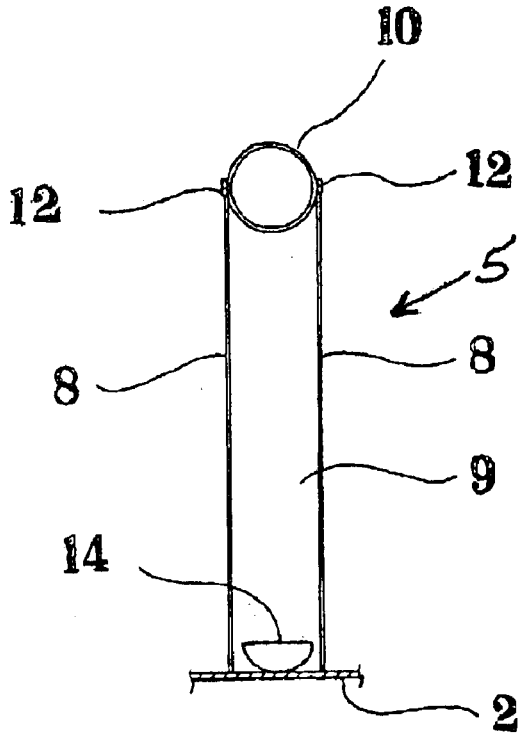
FIG. 6 is a front elevational view showing this alternative embodiment of FIG. 5.
Figure 7:
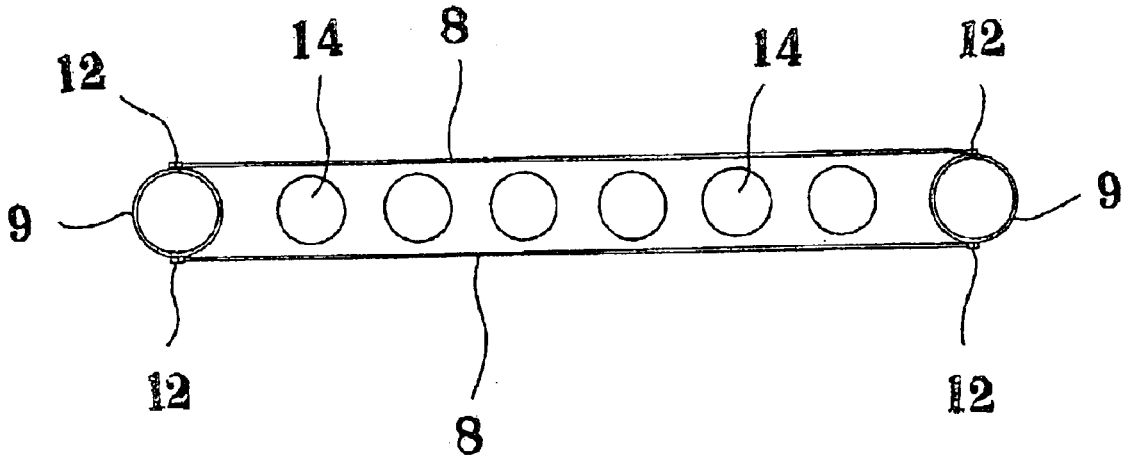
FIG. 7 is a top plan view showing this alternative embodiment of FIG. 5.
Figure 8:
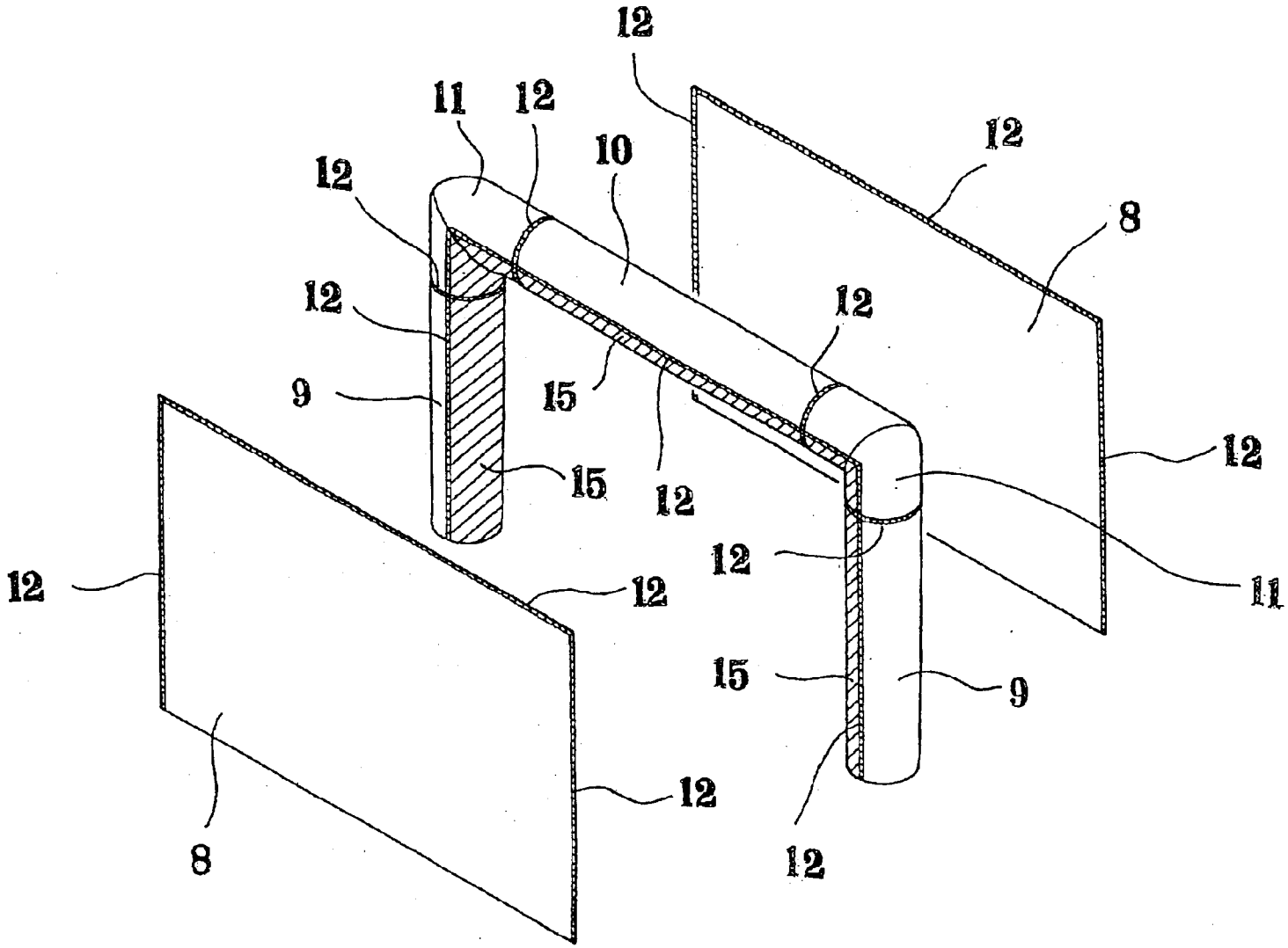
FIG. 8 is an exploded perspective view showing this alternative embodiment of FIG. 5.

According to this embodiment, a gate-shaped (i.e., inverted U-shaped) supporting pipe 7 is formed by a cylindrical pipe made of a synthetic resin sheet, particularly of vinyl sheet and mounted on the vehicle body 2 so as to be selectively inflated and deflated. A single blower 13 for inflation of this supporting pipe 7 is connected to the latter and the sheet 8 for the display of a commercial image and/or message 17. The sheet 8 is laid over the inflated gate-shaped supporting pipe 7, as best seen in FIG. 6, to form the balloon 5 and to display the commercial image and/or message on front and rear halves of the inflated gate-shaped supporting pipe 7. In this manner, the supporting pipe 7 and the sheet 8 cooperate to form the balloon 5. The gate-shaped supporting pipe 7 comprises a pair of vertical pipe sections 9, 9 spaced from each other in a longitudinal direction of the vehicle body 2, a single horizontal pipe section 10 and a pair of L-shaped corner pipe sections 11, 11 serving to connect upper ends of the vertical pipe sections 9, 9 to longitudinally opposite ends of the horizontal pipe section 10. These pipe sections are connected one to another by means of conventional fasteners 12. The gate-shaped supporting pipe 7 and the halves of sheet 8, 8 laid over the gate-shaped supporting pipe 7 are connected to each other also by means of fasteners 12.

The vehicle body 2 is provided with a plurality of lighting means 14 so as to be located between the sheet halves 8, 8 displaying the commercial image and/or message and to illuminate these sheet halves 8, 8. In order to improve the illuminating effect, the gate-shaped supporting pipe 7 has its inner surface optimized, such as by a reflective coating, for diffusive reflection. The single blower 13 is mounted on the vehicle body 2 so as to be located in front of or behind anyone of the vertical pipe sections 9,9 constituting the gate-shaped supporting pipe 7. As will be appreciated from the foregoing description, the balloon-type advertising equipment according to the present invention comprises the vehicle and the balloon mounted on the vehicle so that the balloon may be inflated and deflated as occasion demands and display the commercial image and/or message. In this way, the vehicle may be moved with the balloon deflated to a desired site at which the balloon may be inflated again to offer the effective advertisement.

The balloon-type advertising equipment according to the present invention thus comprises a vehicle and a balloon mounted on the vehicle wherein the balloon is adapted to be inflated and deflated as occasion demands and to display commercial image and/or message. The vehicle may be moved with the balloon deflated to a desired site at which the balloon may be inflated again to offer the effective advertisement. Such advertising equipment can be effective used for short-period advertisement. With this advertising equipment, the balloon may be adapted to be illuminated from inside so that, even in the nighttime, the balloon can be inflated at a desired site and at a desired time to offer the effective advertisement.

In this novel balloon-type advertising equipment, blowers and lighting means may be mounted on an upper part of the vehicle and the balloon may be provided in the form of a bottom-opened box made of a sheet displaying thereon the commercial image and/or message and having its lower part fixed to the upper part of said vehicle. In this way, four advertising panels are ensured and correspondingly effective advertising is offered. In the balloon-type advertising equipment according to the present invention, the balloon in the form of the bottom-open box may be provided on its inner side with supporting means serving to prevent the balloon from collapsing. In this way, the advertising equipment can resist some degree of wind, which also allows the vehicle to move, at least slowly, with the balloon inflated.

In the balloon-type advertising equipment according to the present invention, a gate-shaped supporting pipe made of a synthetic resin sheet so as to be selectively inflated and deflated may be mounted on the vehicle and a blower for inflation of the supporting pipe may be connected to the latter so that the sheet for display of commercial image and/or message may be laid over the inflated gate-shaped supporting pipe to form the balloon and to display the commercial image and/or message on front and rear halves of the inflated gate-shaped supporting pipe. This unique arrangement allows the effective advertisement to be offered using a low power output blower instead of using a high power output blower. The cylindrical supporting pipe may be employed to facilitate the supporting pipe to be rapidly inflated even with a low power blower. The gate-shaped supporting pipe may be composed of a pair of vertical pipe sections each made of a synthetic resin sheet, a single horizontal pipe section made of a synthetic resin sheet and a pair of L-shaped corner pipe sections serving to connect upper ends of said vertical pipe sections to longitudinally opposite ends of the horizontal pipe section.

According to further additional preferred embodiment of vertical pipe sections, corner pipe sections and horizontal pipe section may be connected one to another by means of fasteners. This facilitates assembly and disassembly of the supporting pipe. The gate-shaped supporting pipe and the sheet laid over the gate-shaped supporting pipe so as to display the commercial image and/or message on the front and rear halves of the gate-shaped supporting pipe may be connected to each other by means of fasteners. This facilitates the sheet displaying the commercial image and/or message not only to be rapidly assembled and disassembled but also to be exchanged with another sheet displaying another commercial image and/or message.

The vehicle may be provided with the lighting means so as to be located between the front and rear halves of the sheet. Thus, the balloon may be illuminated from its inside to make the advertisement in the nighttime effective. Furthermore, the gate-shaped supporting pipe may have its inner surface optimized for diffusive reflection to ensure that diffusive reflection on the inner surface of the supporting pipe improves the illuminating effect for the commercial image and/or message.

It will become apparent to those skilled in the art that various modifications to the preferred embodiment of the invention as described herein can be made without departing from the spirit or scope of the invention as defined by the appended claims.

What is claimed:

1. A balloon-type advertising equipment comprising:

a vehicle; and a balloon mounted on said vehicle wherein said balloon is adapted to be inflated and deflated as occasion demands to display an image and/or a message on said balloon, wherein said balloon includes a gate-shaped inflatable supporting pipe so as to be selectively inflated and deflated, the pipe is mounted on the vehicle and a blower for inflation of said supporting pipe is connected to said pipe and a sheet for display of an image and/or message laid over the inflated gate-shaped supporting pipe to define said balloon and to display an image and/or message on the sides of said inflated gate-shaped supporting pipe, and wherein said gate-shaped supporting pipe comprises a pair of vertical pipe sections each made of a synthetic resin sheet, a single horizontal pipe section made of a synthetic resin sheet and a pair of L-shaped corner pipe sections serving to connect upper ends of said vertical pipe sections to longitudinally opposite ends of said horizontal pipe section, wherein said vertical pipe sections, said corner pipe sections and said horizontal pipe section are connected one to another by means of fasteners.

* * * * *